United States Patent [19]

Frost et al.

[11] 4,047,399

[45] Sept. 13, 1977

[54] KNITTING BRAIDS

[75] Inventors: Robert Walter Frost, Tilton-on-the-Hill; Anne Winnifred Morris, Anstey, both of England

[73] Assignee: R. W. Frost Limited, Syston, England

[21] Appl. No.: 636,757

[22] Filed: Dec. 1, 1975

[30] Foreign Application Priority Data

Jan. 17, 1975 United Kingdom ..... 2011/75

[51] Int. Cl.[2] ..... D04B 15/88

[52] U.S. Cl. ..... 66/149 R; 66/193; 66/209

[58] Field of Search ..... 66/83, 84, 85, 132, 66/147, 209, 152, 149, 125

[56] References Cited

U.S. PATENT DOCUMENTS

| | | | |
|---|---|---|---|
| 1,346,136 | 7/1920 | Schwab | 66/152 |
| 1,841,165 | 1/1932 | Vorck et al. | 66/84 |
| 2,064,074 | 12/1936 | McNamee | 66/169 |
| 2,213,720 | 9/1940 | Seim | 66/1 |
| 3,653,230 | 4/1972 | Tosco | 66/85 |
| 3,774,662 | 11/1973 | Neville et al. | 66/84 X |

FOREIGN PATENT DOCUMENTS

| | | | |
|---|---|---|---|
| 374,606 | 2/1932 | United Kingdom | 66/193 |

*Primary Examiner*—Ronald Feldbaum
*Attorney, Agent, or Firm*—Larson, Taylor and Hinds

[57] ABSTRACT

The invention relates to a method and apparatus for knitting a narrow band in which a special effect yarn for use in the band and the band itself, are knitted simultaneously on one machine and the special effect yarn is taken off and guided directly to the needles knitting the band.

8 Claims, 7 Drawing Figures

KNITTING BRAIDS

The invention relates to a method of warp-knitting bands, to bands knitted by the said method and to warp knitting machines arranged to knit such bands.

In the warp knitting of bands, needles on a needle bar knit chains of stitches of ground yarn while warp inlay tubes shog to and fro to lay in inlay yarns which give each resulting band its characteristic decorative appearance. It is usual to provide one or more inlay yarns which are not simple yarns but are themselves knitted on a chainette machine into so-called special effect yarns which stand out visually in the resulting bands, generally as relief pattern. In this way there can be knitted bands which are used as decorative trimmings for a wide range of textile products. In this Specification the term "special effect yarn" is used to describe a yarn which itself comprises knitted stitches and is suitable for feeding as a warp inlay to a warp knitting machine.

The invention provides a method of warp-knitting a band, comprising knitting at least one special effect yarn (as herein defined) on one or more needles of a warp knitting machine, taking off the special effect yarn and feeding it directly as a warp inlay yarn to other needles of the same machine.

The or each special effect yarn may be a single or multiple chain warp knitted yarn, with or without inlay yarns. In the simplest form, it is a single chain of stitches, but for different appearances of the final braid there may be formed special effect yarns comprising more than one chain of stitches bound together by warp inlay yarns. In this way it is possible to build up a special effect yarn that is itself a ribbon or tape, and inlay this into the final band in the usual way. If desired, the needles knitting the final band may pierce such a ribbon inlay to provide a particularly distinctive appearance of final band. If more than one special effect yarn is knitted and laid into the band, the different special effect yarns need not necessarily be identical. In the simplest form of the invention, however, the or each special effect yarn is a single chain warp knitted yarn.

The invention also provides a warp knitting machine for knitting bands according to the above method, comprising a warp knitting machine for knitting bands, having needles for knitting a number of special effect yarns (as herein defined), take-off rollers for the special effect yarns and guide means for feeding the special effect yarns to other needles of the machine as warp inlay yarns. The needle knitting the special effect yarn or yarns may be individual needles knitting individual chains or groups of needles knitting chains that are held together by one or more warp inlay yarns. A number of bands will in practice be knitted side by side on a single machine.

The needles knitting the special effect yarns may be in the same needle bed as the other needles knitting the final bands and fed with yarn from yarn guides mounted on the same yarn guide bar.

A relatively simple modification is all that is required to convert an existing warp knitting machine into one that will operate in this way. All that is necessary is to provide take-off rollers for the special effect thread or threads, and guide means for feeding the special effect thread or threads to warp inlay tubes of the machine. To enable the special effect yarns to be laid into the final bands in a non-linear pattern the take-off rollers for the special effect yarns will operate at a faster take-off rate than those for the final band. This causes longer loops to be drawn for the special effect yarn than for the base chains of the final band, the stitch length being directly related to the take-off rate. If more than one special effect yarn is inlaid into each band, each may pass through the nip of the same take-off rollers so as to produce special effect yarns of the same length, or different special effect yarns may be taken off by means of different take-off rollers rotating at different speeds, so as to provide a greater length of one such yarn than another. The former take-off procedure would be used when the pattern in the final band is such that identical lengths of the special effect yarns are called for, and the latter procedure is used when the pattern demands different lengths of the special effect yarns.

Preferably the take-off rollers for the special effect yarns act as a positive feed mechanism for feeding the special effect yarns to warp inlay tubes of the machine for introducing them as warp inlays in the final knitted bands. A separate positive feed mechanism is preferably provided for warp inlays other than the special effect yarns.

A machine with greater flexibility is provided if the special effect yarns are knitted on a separate needle bed but under the control of the same drive mechanism as that controlling the needle bed for knitting the final bands. Such a machine would have a first needle bed and associated yarn guide bar and possibly warp inlay bar(s) for knitting the special effect yarns, and a second needle bed, yarn guide bar and one or more warp inlay bars for knitting the final bands. Although the needle beds would be under the control of the same drive mechanism, the first would be geared to operate at a faster rate than the second, for example in a 2:1 ratio. The stitch length of the special effect yarns would then be decreased, thus varying the appearance of the special effect yarns and of the final bands. For further control, a clutch or other drive-interruption means may be provided to the needle bed knitting the special effect yarns and coupled to means for sensing the length of a storage loop of one of the special effect yarns so knitted. Such a machine would be geared to knit the special effect yarns at a rate in excess of demand, so as to build up the above storage loop. When the storage loop had reached a predetermined size, the needles knitting the special effect yarns would cease operation and the storage loop would be used up as the knitting of the band proceeded. When the storage loop was at a predetermined minimum size, knitting of the special effect yarns would recommence. The advantage of such a machine would be that the stitch length of the special effect yarns could be made quite independent of the demand for the said yarns in the final bands.

The special effect yarn may also be knitted by lapping a single yarn around two or more needles in a single lapping movement.

The invention is hereinafter particularly described by way of example only, with reference to the drawings of which:

Figure 1:
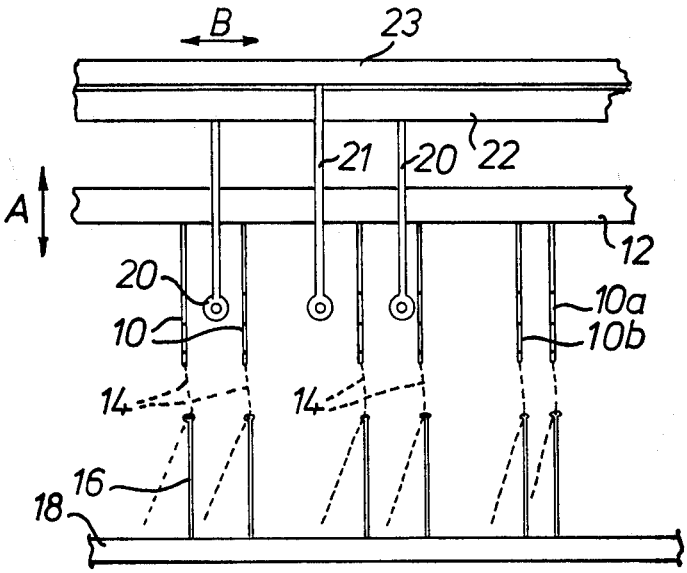
FIG. 1 is a schematic plan view of part of a needle bed of a warp knitting machine according to the invention.
Figure 2:
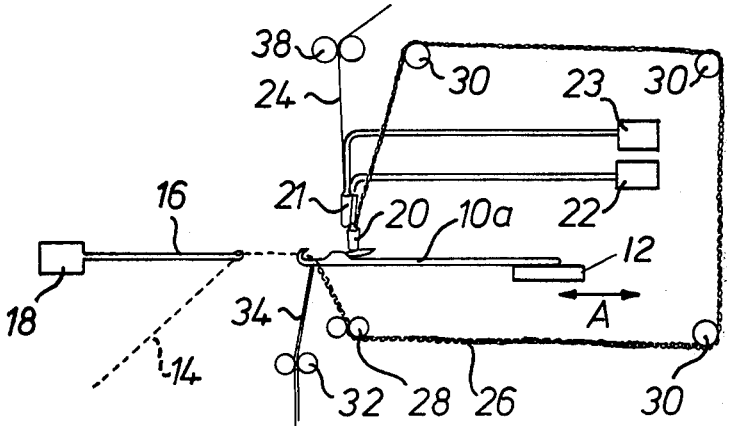
FIG. 2 is an equally schematic side elevation of the needle bed, showing the path of the special effect yarns from the needles on which they are knitted to the warp inlay tubes feeding them to other needles of the machine.
Figure 3:
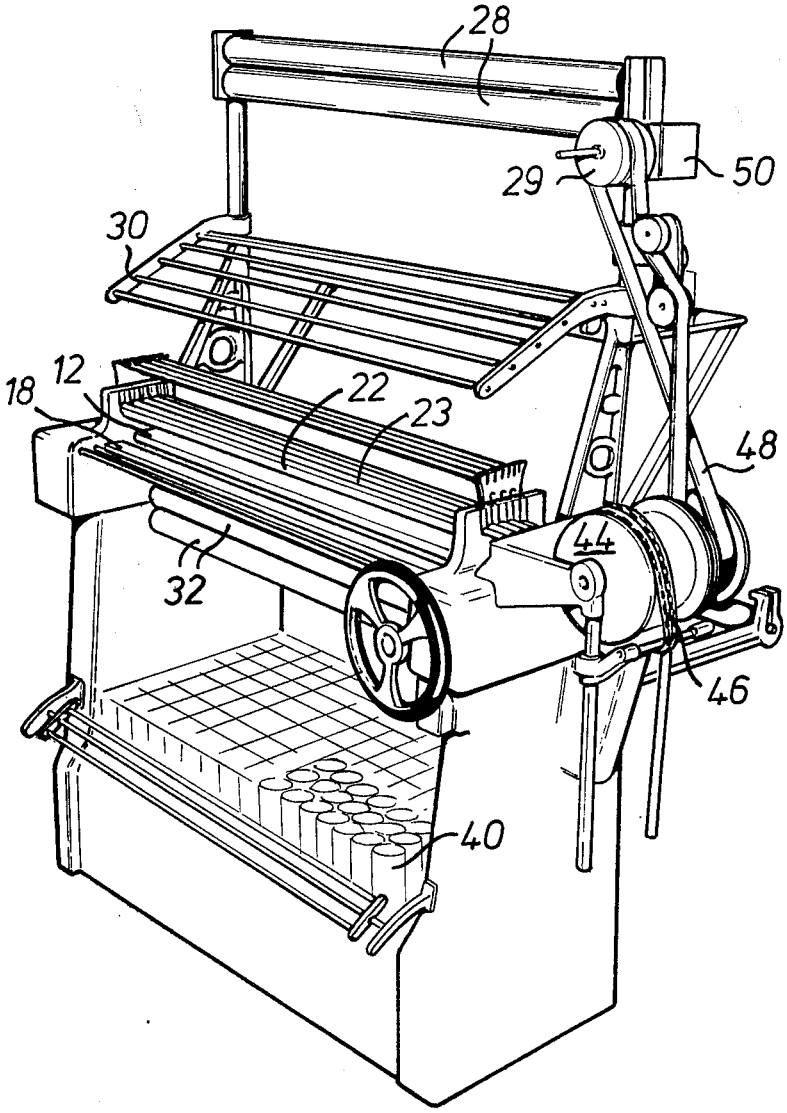
FIG. 3 is a perspective front elevation of a warp knitting machine according to the invention.

With reference to FIG. 1, the warp knitting machine includes needles 10 on a needle bar 12 which is controlled to move reciprocally in the direction of the arrow A. In practice, the warp knitting machine will have a number of knitting stations such as that shown in FIG. 1 arranged side by side along the length of the needle bed, and will produce a number of identical bands in unison. Selected ones of the needles 10 are fed with a ground yarn 14 through yarn guides 16 mounted on a yarn guide bar 18. The yarn guide bar 18 performs a lapping movement so as continuously to lap the ground yarns 14 around the needles in synchronism with the reciprocal movement of the needle bar 12. At the same time warp inlay tubes 20 and 21 mounted on warp inlay bars 22 and 23 respectively feed special effect yarns 26 and a warp inlay thread 24 respectively to the needles 10 as shown in FIG. 2. The movement of the warp inlay tubes 20 and 21 is a combination of an up-and-down movement which lays in the warp inlay yarns around the chains of knitted stitches produced from the ground yarn 14, and a lateral reciprocal movement in the direction of the arrow B. As seen in FIG. 2, chains of knitted stitches 26 formed by certain needles 10*a* and 10*b* of the needles 10 of FIG. 1 are taken off at a rate controlled by the drive means of the machine between take-off rollers 28, and passed around guides 30 to be fed as the special effect warp inlay yarns through the warp inlay tubes 20. A separate pair of take-off rollers 32 is provided for the final knitted band 34. The other warp inlay yarns 24 are shown as being fed to the warp inlay tubes 21 through positive feed rollers 38, although they may alternatively be free fed.

The machine illustrated in FIGS. 3 to 7 operates in principle in the same way as that described with reference to FIGS. 1 and 2 and corresponding parts are indicated with the same reference numerals.

Figure 5:
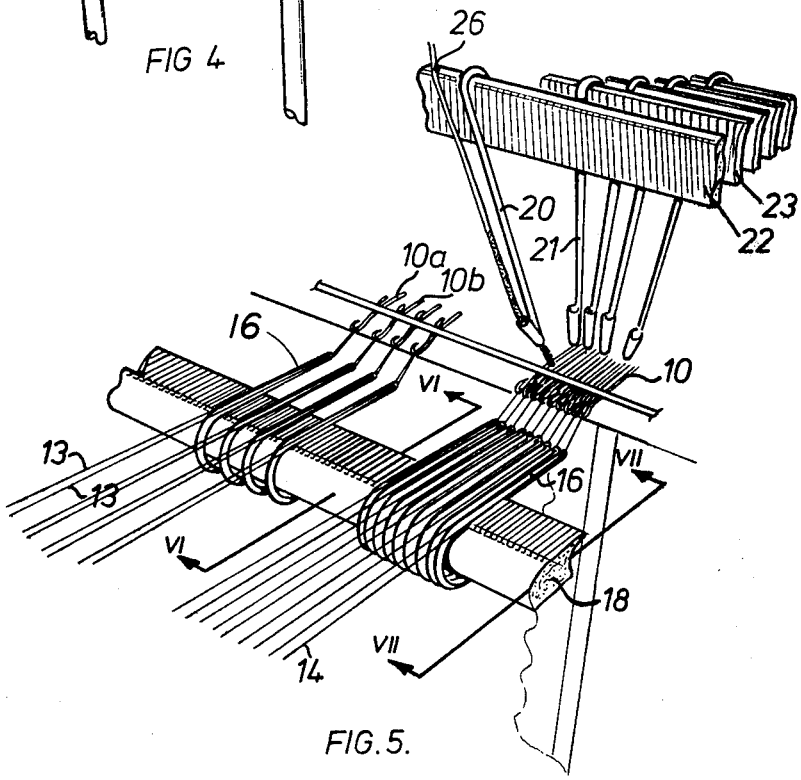
FIG. 5 is an enlarged perspective view of the knitting instruments of the machine of FIG. 3.

The ground yarns 14 are supplied from spools 40. FIG. 5 shows a form of knitting wherein two yarns 13 are supplied to each of a group of four guides 16 to knit with the needles 10*a* and 10*b* four special effect yarns 26. At the same time, one ground yarn 14 is supplied to each of a group of nine guides to knit with the needles 10 opposite and the special effects yarns 26 supplied through the inlay tubes 20, 21 the band 34.

Figure 4:
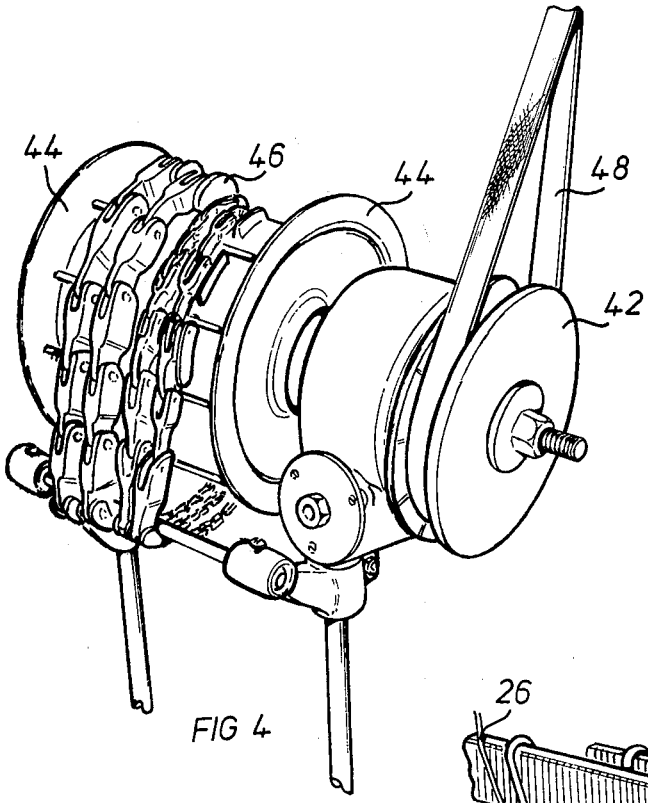
FIG. 4 is a perspective view of a drive pulley for a take down mechanism of the machine of FIG. 3.

FIG. 4 shows part of a drive mechanism for the take-off rollers 28. A pulley 42 is coupled to the rotatable wheel 44, which in combination with chains 46, reciprocate the warp inlay bars 22, 23. The pulley 42 drives a belt 48 which turns a worm rotating a worm wheel received in a housing 50 next to the take-off rollers 28. The speed of the take-off rollers 28 can be set at the required level above that of the take-off rollers 32 by adjusting the diameter of the pulley 42, the ratio of the worm and wheel and the diameter of the pulley 29. Thus the take-off speed can be accurately varied within a wide range.

Figure 6:
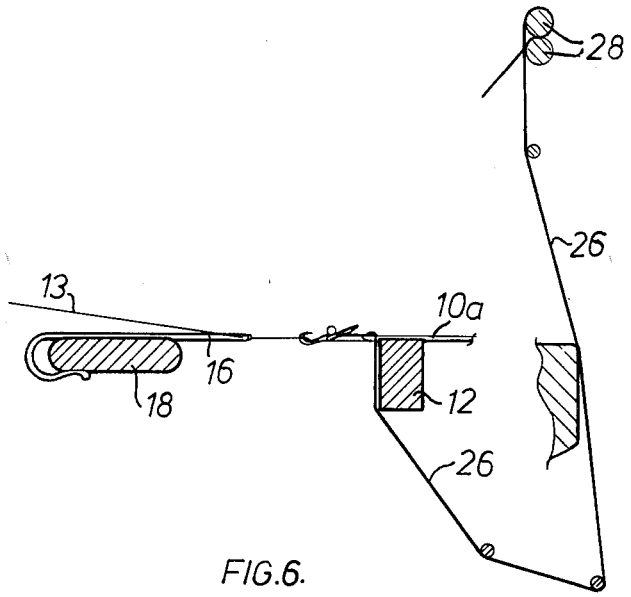
FIG. 6 is a section along line VI—VI in FIG. 5 of the machine of FIG. 3.
Figure 7:
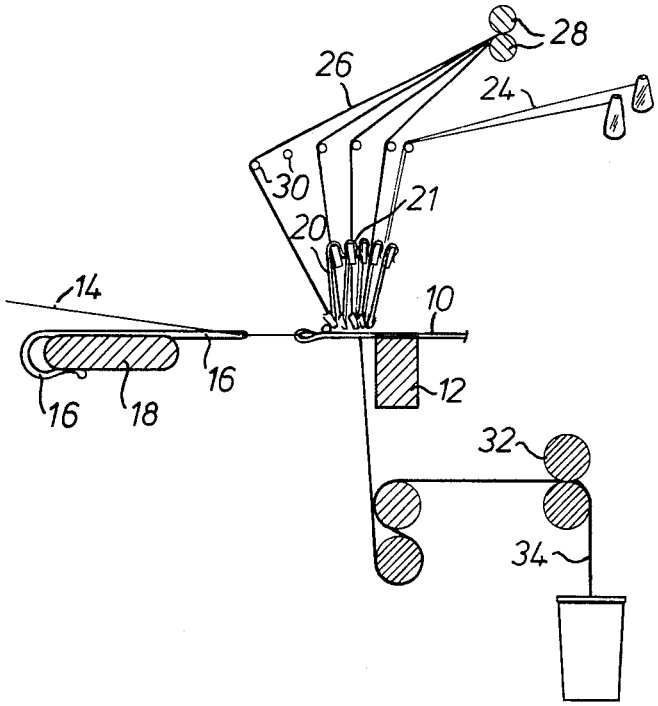
FIG. 7 is a section along line VII—VII in FIG. 5 of the machine of FIG. 3.

FIG. 6 illustrates the paths of the four special effect yarns. FIG. 7 illustrates how these special effect yarns are combined to give the band 34 with the ground yarns 14 and the further inlay threads 24.

The chains 46 are set so as to reciprocate the inlay tubes for the special effect yarns 26 on the left-hand side of the group of ground yarns 14 to form the main effect pattern and to reciprocate the inlay tubes for the threads 24 on the right hand side to form a dense selvedge structure. The ground yarns 14 form thin, virtually invisible elongate chains which yarn the special effect yarns 26 and the threads 24.

Generally the inlay yarn is inserted without any overlap using underlap only. For certain applications the inlay tube may be held stationary without any movement at all.

The invention greatly simplifies the overall process for converting yarns into bands with effect patterns because it is no longer necessary to knit the special effect yarn in a separate operation, untangle it and wind it on a bobbin for supplying a warp inlay tube in a subsequent knitting operation. The administrative duties become greatly simplified. Whereas it might in the past be impossible to supply a band with a large number or variety of special effect yarns at an economic price, such bands can now be made without the creation of excessive overheads for administration, storage etc.

We claim:

1. Method of warp knitting a narrow band comprising, knitting a narrow band using first needles of a warp knitting machine to knit ground yarns of the narrow band and using at least one inlay guide of the warp knitting machine to incorporate a special effect thread into the narrow band and taking off the narrow band at a first take-off speed;

knitting the said special effect thread using at least one second needle of the said warp knitting machine at the same time as the special effect thread is being incorporated into the narrow band and taking off the said special effect thread at a second take-off speed higher than the first take-off speed and guiding a length of the thread to the said inlay guide.

2. Method as claimed in claim 1 wherein the special effect yarn is a single chain warp knitted yarn.

3. Method as claimed in claim 1 wherein the first needles and the second needle are mounted on a joint needle bed.

4. Method as claimed in claim 1 wherein the special effect yarn is shogged to and fro across the second needle to give a zig-zag effect.

5. Method as claimed in claim 1 wherein the first needles and the second needle are arranged adjacent to each other on a needle bed, the inlay guide is reciprocated over the first needles, and the special effect yarn is guided to the inlay guide over the top of the needle bed.

6. Warp knitting machine for knitting a narrow band, comprising:

a needle bed, first needles on the needle bed for knitting ground yarns for a narrow band, at least one inlay guide for incorporating a special effect yarn into the narrow band, means for reciprocating the inlay guide and first take-off means for taking off the narrow band at a first speed;

at least one second needle on the said needle bed for knitting the said special effect thread, second take-off means for taking off the special thread at a second speed higher than the first and means for guiding the special effect thread from the second needle around the needle bed to the appropriate inlay guide.

7. Warp knitting machine as claimed in claim 6 including adjustment means associated with the second take-off means for varying the take-off speed of the special effect thread.

8. A warp knitting machine as claimed in claim 6 wherein a plurality of adjacent sets of first needles and at least one second needle are provided on the said needle bed and the first and second take-off means each include a pair of rollers extending along the bed for taking off the narrow bands and the special effect threads respectively at different speeds.

* * * * *